US010994159B2

(12) United States Patent
Farnaby et al.

(10) Patent No.: US 10,994,159 B2
(45) **Date of Patent: *May 4, 2021**

(54) HARNESS FOR BREATHING APPARATUS

(71) Applicant: Draeger Safety UK Limited, Blyth (GB)

(72) Inventors: James Farnaby, Newcastle upon Tyne (GB); David Cheesman, Northumberland (GB); Gordon Wrigley, Newcastle upon Tyne (GB)

(73) Assignee: DRAEGER SAFETY UK LIMITED, Northumberland (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/741,408

(22) Filed: Jan. 13, 2020

(65) Prior Publication Data

US 2020/0147419 A1 May 14, 2020

Related U.S. Application Data

(63) Continuation of application No. 16/012,437, filed on Jun. 19, 2018, now Pat. No. 10,569,108.

(30) Foreign Application Priority Data

Jun. 27, 2017 (GB) ..... 1710255

(51) Int. Cl.
*B63C 11/22* (2006.01)
*A63B 25/00* (2006.01)
(Continued)

(52) U.S. Cl.
CPC ..... *A62B 9/04* (2013.01); *A45F 3/047* (2013.01); *A45F 3/08* (2013.01); *B63C 11/22* (2013.01);
(Continued)

(58) Field of Classification Search
CPC .... A45F 3/14; A45F 3/047; A45F 3/06; A45F 3/08; A45F 3/10; A45F 2003/045; A62B 25/00; A62B 9/04; B63C 2011/026
See application file for complete search history.

(56) References Cited

U.S. PATENT DOCUMENTS 1,316,915 A 9/1919 Meyer et al.
2,943,775 A 7/1960 Mack
(Continued)

FOREIGN PATENT DOCUMENTS

EP 0 747 095 A2 12/1996
GB 2 059 750 4/1981
(Continued)

OTHER PUBLICATIONS

Examination Report dated Nov. 11, 2019, of counterpart European Application No. 18179370.4.
(Continued)

*Primary Examiner* — Justin M Larson
(74) *Attorney, Agent, or Firm* — Saul Ewing Arnstein & Lehr LLP

(57) ABSTRACT

There is disclosed a harness for breathing apparatus comprising a structural support member for supporting a vessel of breathable gas, a waist belt, and a pivot joint mechanism coupling the structural support member to the waist belt. The pivot joint mechanism comprises a release part which is movable to decouple the structural support member from the waist belt.

12 Claims, 4 Drawing Sheets

Figure 1:
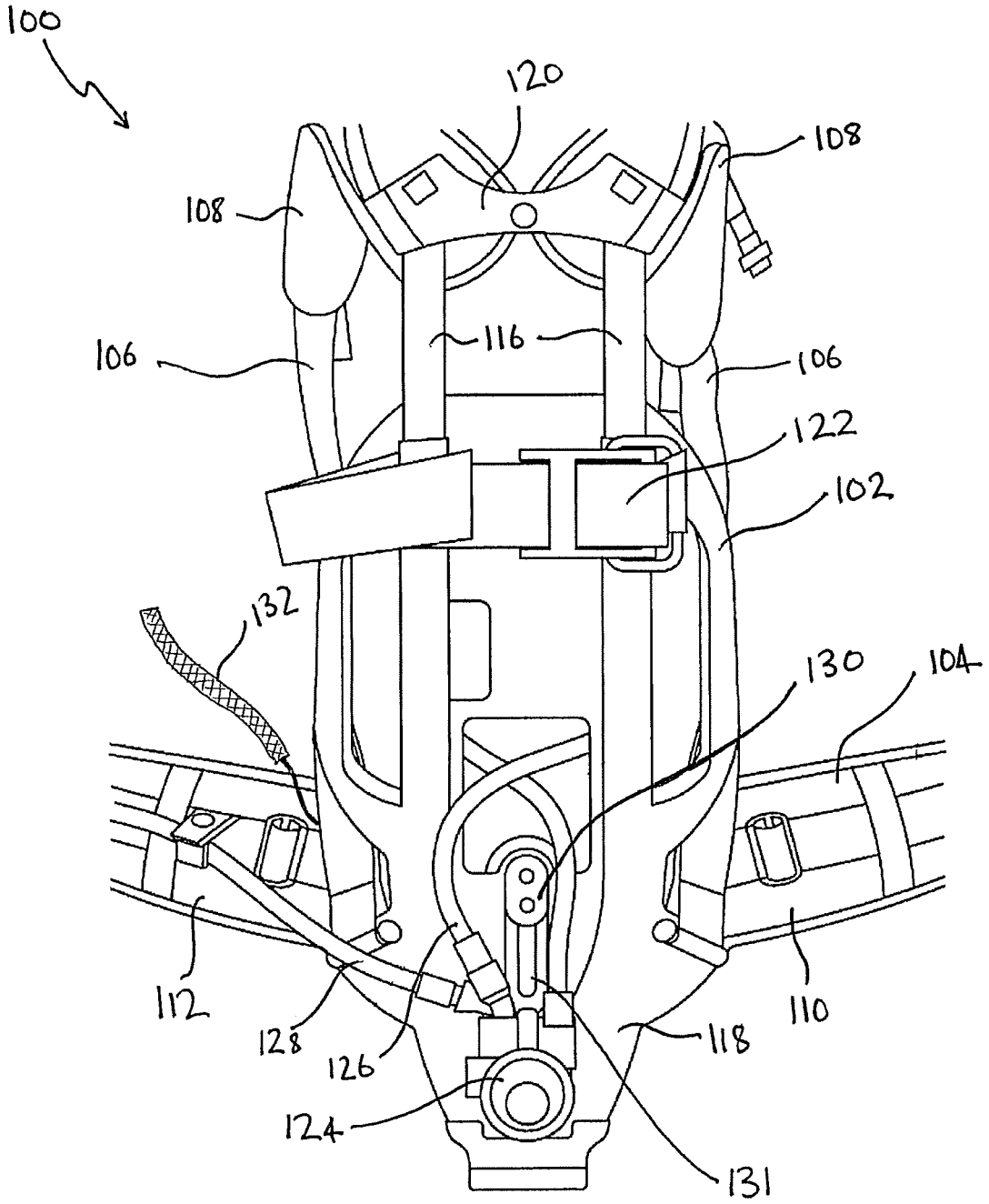

(51) Int. Cl.

| | |
|---|---|
| ***A62B 9/04*** | (2006.01) |
| ***A45F 3/04*** | (2006.01) |
| ***A45F 3/10*** | (2006.01) |
| ***A45F 3/14*** | (2006.01) |
| ***B63C 11/02*** | (2006.01) |
| ***A45F 3/08*** | (2006.01) |
| *A62B 25/00* | (2006.01) |

(52) U.S. Cl.

CPC . *A45F 3/10* (2013.01); *A45F 3/14* (2013.01); *A45F 2003/045* (2013.01); *A45F 2003/144* (2013.01); *A45F 2003/146* (2013.01); *A62B 25/00* (2013.01); *B63C 2011/026* (2013.01)

(56) References Cited

U.S. PATENT DOCUMENTS

| | | | | |
|---|---|---|---|---|
| 3,355,075 | A | 11/1967 | Dean | |
| 4,015,759 | A | 4/1977 | Dreissigacker et al. | |
| 4,911,346 | A | 3/1990 | Shallman | |
| D342,666 | S | 12/1993 | DePack | |
| 5,390,886 | A * | 2/1995 | Lawner | B63C 11/02 248/224.7 |
| 5,609,278 | A | 3/1997 | Fresco | |
| 5,732,867 | A | 3/1998 | Perkins et al. | |
| 5,887,836 | A | 3/1999 | Back | |
| 6,079,602 | A | 6/2000 | Howell | |
| 6,290,111 | B1 * | 9/2001 | Hedenberg | A45F 3/10 224/262 |
| 6,830,226 | B2 * | 12/2004 | Field | A62C 13/78 248/313 |
| 6,848,120 | B2 * | 2/2005 | Kling | A62B 9/04 2/2.15 |
| 7,726,312 | B2 * | 6/2010 | Chapman | A62B 25/00 128/205.22 |
| 7,770,766 | B2 | 8/2010 | Foissac et al. | |
| 8,006,877 | B2 | 8/2011 | Lowry et al. | |
| 8,182,439 | B2 | 5/2012 | Glenn | |
| 8,312,600 | B2 | 11/2012 | Colorado | |
| 8,336,171 | B2 | 12/2012 | Colorado | |
| 8,584,917 | B2 | 11/2013 | Hexels | |
| 8,608,040 | B2 | 12/2013 | Cheesman et al. | |
| 8,695,171 | B2 | 4/2014 | Colorado | |
| 8,857,681 | B2 | 10/2014 | Burnett et al. | |
| 9,220,333 | B2 | 12/2015 | Losos et al. | |
| 9,586,065 | B2 * | 3/2017 | Losos | A45F 3/04 |
| 9,629,443 | B2 | 4/2017 | Searle et al. | |
| 9,700,122 | B2 | 7/2017 | Pelland et al. | |
| 9,943,714 | B2 | 4/2018 | Steck et al. | |
| 10,004,320 | B2 | 6/2018 | Reid et al. | |
| 10,028,570 | B2 | 7/2018 | Beck | |
| 10,137,319 | B2 | 11/2018 | Carr et al. | |
| 10,569,108 | B2 * | 2/2020 | Farnaby | A45F 3/047 |
| 10,690,178 | B2 * | 6/2020 | Brose | A62B 17/04 |
| RE48,093 | E * | 7/2020 | Hairston | A45F 3/10 |
| 2008/0257928 | A1 * | 10/2008 | Lowry | A62B 9/04 224/638 |
| 2010/0243694 | A1 | 9/2010 | Oddou et al. | |
| 2010/0282252 | A1 | 11/2010 | Cheesman et al. | |
| 2011/0108595 | A1 | 5/2011 | Hoag | |
| 2011/0179608 | A1 | 7/2011 | Colorado | |
| 2013/0232742 | A1 | 9/2013 | Burnett et al. | |
| 2013/0240292 | A1 | 9/2013 | Steck et al. | |
| 2014/0151424 | A1 | 6/2014 | Hexels | |
| 2014/0345604 | A1 | 11/2014 | Wang et al. | |
| 2015/0144675 | A1 | 5/2015 | Losos et al. | |
| 2015/0320150 | A1 | 11/2015 | Beck | |
| 2016/0022018 | A1 | 1/2016 | Searle et al. | |
| 2018/0369617 | A1 * | 12/2018 | Farnaby | A45F 3/08 |
| 2019/0174901 | A1 * | 6/2019 | Shtriker | A45F 3/06 |
| 2020/0238110 | A1 * | 7/2020 | Plummer | A62B 25/00 |

FOREIGN PATENT DOCUMENTS

| | | |
|---|---|---|
| GB | 2 303 795 | 3/1997 |
| GB | 2 418 133 A | 3/2006 |
| WO | 00/08971 | 2/2000 |
| WO | 2007/056828 A1 | 5/2007 |
| WO | 2012/061806 | 5/2012 |

OTHER PUBLICATIONS

Extended Search Report dated Nov. 19, 2018, of counterpart European Application No. 18179370.4.

Search Report dated Dec. 27, 2017, of counterpart Great Britain Application No. 1710255.9.

* cited by examiner

HARNESS FOR BREATHING APPARATUS

The invention relates to a harness for breathing apparatus.

Self-contained breathing apparatus (SCBA) typically comprises a structural support member in the form of a back plate or back frame, a pair of shoulder straps and a waist belt. The support member is provided with a valve towards the lower end and a retaining strap. In use, a cylinder of breathable gas is attached to the valve and is secured to the back plate by means of the retaining strap. Various hoses, valves and other equipment conveniently enable a user to breathe the breathable gas contained in the cylinder.

The waist belt and the support member of the SCBA are typically connected together such that the load of the SCBA can be spread between the shoulder straps and the waist belt. However, in some scenarios, it may be necessary to quickly remove the bulky support member of the SCBA, for example if its user needs to "bail-out" of a window or other narrow escape route in a dangerous situation. It may be desirable for the waist belt to remain attached to the user so that it can be used for connecting a safety line, escape tools, or the like. Accordingly, a release mechanism may be provided to rapidly disconnect the support member of the SCBA from the waist belt.

As the release mechanism will typically only be used as in last resort escapes from life-threatening situations, its operation may be rare. However, the release must be fast, reliable, and simple to actuate, as its failure may result in serious injury or the death of the user who is unable to escape through a narrow escape route. Accordingly, it will be understood that improvements in the area of release mechanisms for SCBAs are desirable.

According to an aspect there is provided a harness for breathing apparatus, such as self-contained breathing apparatus (SCBA), comprising a structural support member for supporting a vessel of breathable gas, a waist belt, and a pivot joint mechanism coupling the structural support member to the waist belt and permitting pivoting/rotating movement therebetween, the pivot joint mechanism comprises a release part which is movable to decouple the structural support member from the waist belt. The vessel of breathable gas may be a cylinder of breathable gas. The structural support member may be arranged to support plural vessels or cylinders of breathable gas. The waist belt may be arranged to be fastened around a wearer's waist.

The harness may provide the advantage that decoupling of the waist belt and the structural support member may be effected at the pivot joint mechanism. A further separate release mechanism may not be required. The harness may therefore be lighter, cheaper, and more easily manufactured when compared to previously considered arrangements. In some arrangements a further separate release mechanism may also be provided to provide redundancy in the system in the event that decoupling via one of the mechanisms fails.

The structural support member may be a support frame or a support plate, for example. The structural support member may be rigid or flexible. The harness may further comprise one or more shoulder straps, such as left and right shoulder straps, such that the harness can be worn on the back of a wearer.

The release part may be removable to decouple the structural support member from the waist belt. Removable may require that the release part is completely separable from the other parts of the pivot joint mechanism.

The pivot joint mechanism may provide articulation between the structural support member and the waist belt about a pivot axis. The pivot axis may be a substantially horizontal axis (i.e. an axis transverse to the wearer's body). The substantially horizontal pivot axis may be a primary pivot axis. The pivot joint mechanism may also be pivotable about a secondary pivot axis substantially perpendicular to the primary pivot axis. The pivot joint mechanism may be pivotable about a vertical pivot axis.

The pivot joint mechanism may comprise a first knuckle coupled to the structural support member and a second knuckle coupled to the waist belt. The first and second knuckles may be pivotable relative to each other. One or both of the structural support member and the waist belt may each comprise a plurality of knuckles. The knuckles of the structural support member and the waist belt may in combination form a barrel through which a pivot pin may be arranged.

The release part may comprise a pivot pin of the pivot joint mechanism which defines a pivot axis of the pivot joint mechanism. The pivot pin may be referred to as a pivot rod. The pivot pin may be arranged in the barrel formed by the knuckles of the structural support member and the waist belt. The pivot pin may be slidable within the barrel.

The pivot pin may be slidably removable along the pivot axis. The pivot pin may be slidably removable in only one direction along the pivot axis, or may be slidably removable along both directions along the pivot axis. The pivot axis defined by the pivot pin may be a substantially horizontal pivot axis.

When wearing the harness, the pivot joint mechanism may provide articulation between the structural support member and the waist belt when the user bends forwards and back at the waist. Therefore, such a horizontal pivot pin may be conveniently located for the user to apply a sideways/lateral force away from their body to remove the pin from the pivot joint mechanism along the pivot axis.

The harness may further comprise a retainer to resist or inhibit movement of the release part of the pivot joint. The retainer may exert a retaining force on the release part which must be overcome in order to move the release part. Accordingly, the release part may not be removed unless it is intended to be removed by the user and accidental removal of the release part may be avoided, which could be dangerous in emergency situations.

The retainer may comprise a deformable (e.g. resiliently deformable) collar or gaiter which surrounds at least a part of the pivot joint mechanism. The resiliently deformable collar or gaiter may have a sealing surface which seals against a surface of the structural support member or the waist belt to prevent access to the hinge. The resiliently deformable gaiter may comprise rubber or silicone rubber.

The retainer may be a detent. The detent may comprise a resiliently biased projection such as a spring-loaded element, such as a ball bearing. The detent may be formed on the release part and may interact with other parts of the pivot joint mechanism. In some examples, the detent may be formed on a portion of the pivot pin which is exposed outside the barrel formed by the knuckles of the structural support member and the waist belt. The detent or projection may extend radially from the pin such that a width of the pin and the detent is greater than a diameter of the barrel. Accordingly, in order to be removed, a pulling force must be applied which overcomes the spring force which extends the detent from the pin such that the detent is received into the pin to such an extent that the pin can fit through the barrel to be removed.

The harness may further comprise a release strap coupled to the release part. The release strap may be operable to move the release part so as to decouple the structural support member from the waist belt. The release strap may be arranged to move the release part when the release strap is pulled. The release strap may be connected to one end of the pivot pin. The pin may be arranged to be removed in the direction of the release strap along the pivot axis. In some examples, release straps may be connected to both ends of the pivot pin such that the pivot pin can be removed in both directions along the pivot axis. In these examples, the release straps may be narrower than the pivot pin or otherwise compressible such that the release strap on the opposite side to the release strap not being used can also be removed in the same direction.

The release strap may be stowable or stowed such that access to the release strap is inhibited. The harness may further comprise a storage pouch in which the release strap can be stowed or is stowed. The release strap may be stowable or stowed in a storage configuration. The release strap may be securable to the waist belt, the structural support member or another part of the harness, for example by hook-and-loop fasteners or similar releasable connection means.

The harness may further comprises a storage pouch in which the release strap is or can be stowed. The storage pouch may be arranged on the waist belt, or on the structural support member, or on another part of the harness. The storage pouch may be securable in a closed position using hook-and-loop fasteners or similar releasable connection means.

The release strap may comprise a visually distinctive portion to enable easy location of the release strap by a user. The visually distinctive part may be easily distinguishable from the remainder of the breathing apparatus such that the release strap can be easily located by a user in a short time and in low visibility.

The visually distinctive part may comprise a brightly coloured or a high-visibility portion. The portion may be reflective, luminescent, fluorescent, phosphorescent, or any combination thereof. The highly distinctive part may comprise a textured part which is distinguishable from other parts of the breathing apparatus by touch. Thus, if visibility is severely reduced or there is no visibility According to another aspect there is provided a method of decoupling a structural support member of a breathing apparatus from a waist belt of the self-contained breathing apparatus comprising moving a release part of a pivot joint mechanism coupling the structural support member to the waist belt to thereby decouple the structural support member from the waist belt.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Figure 2:
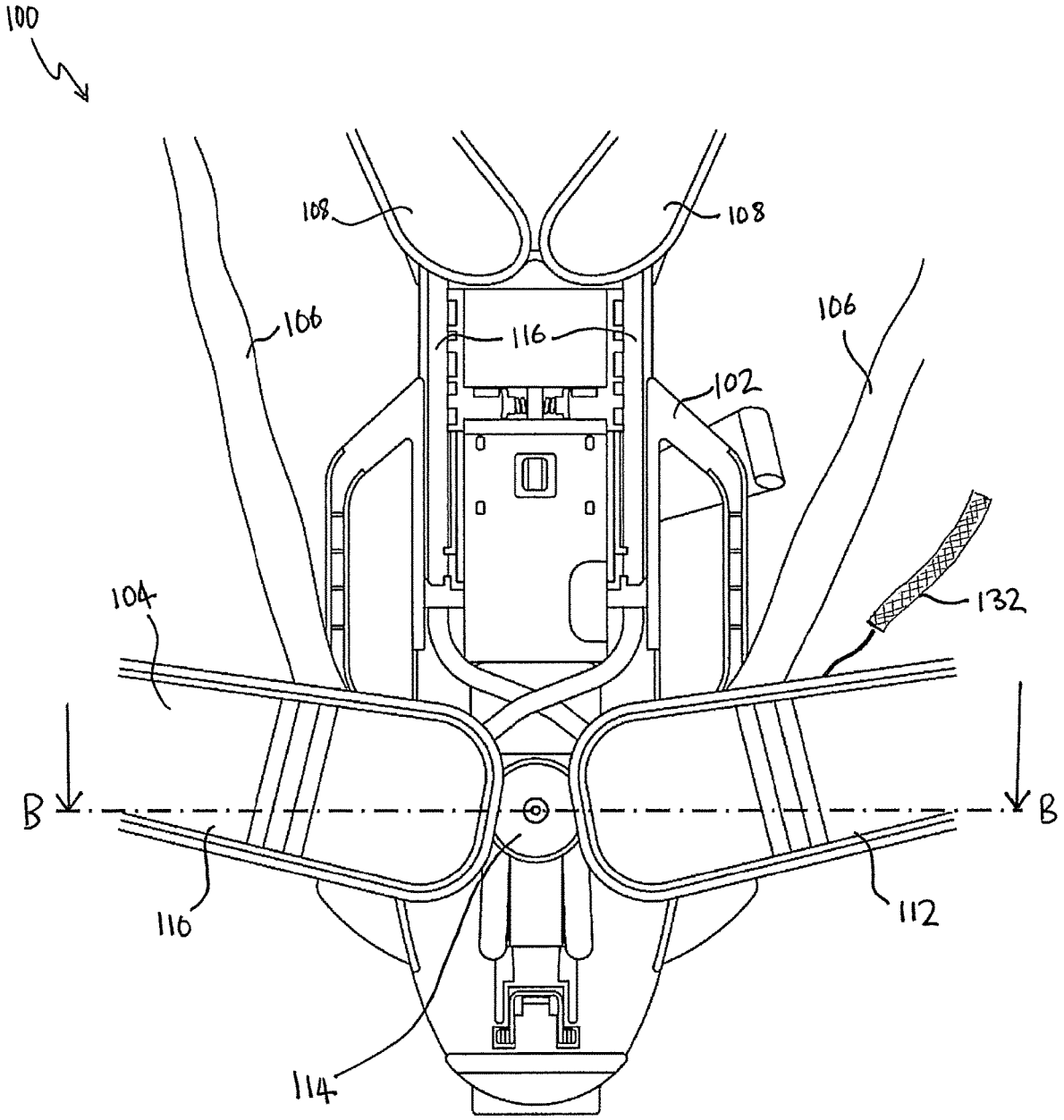
Figure 3A:
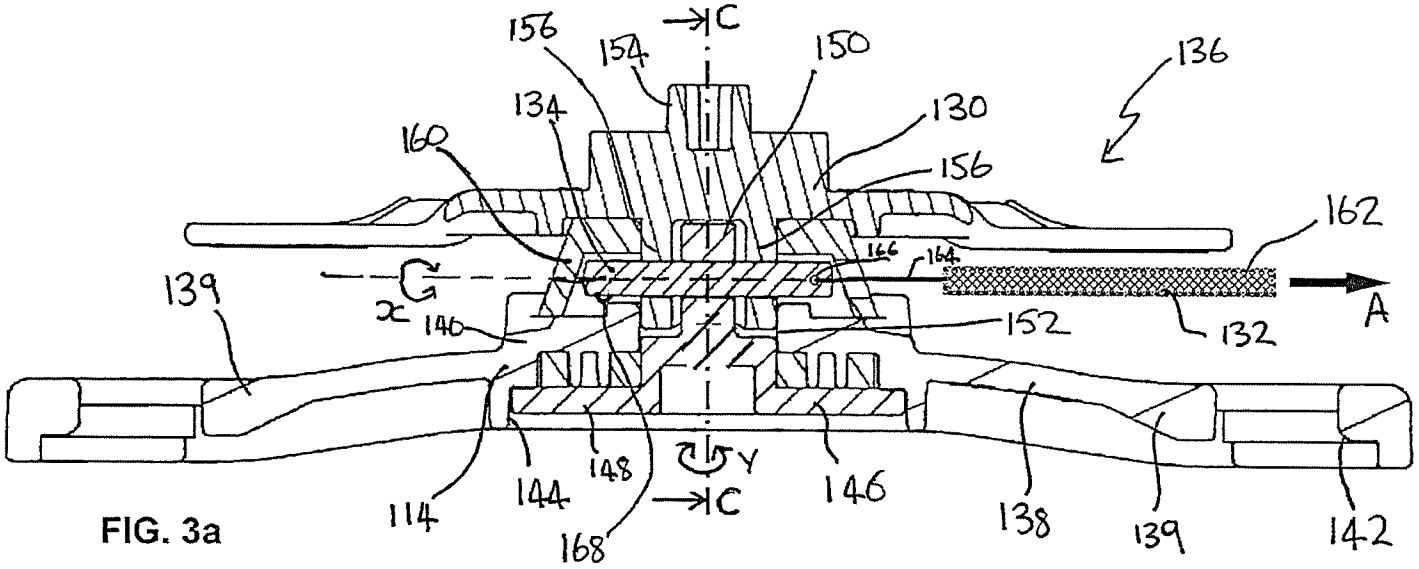
Figure 3B:
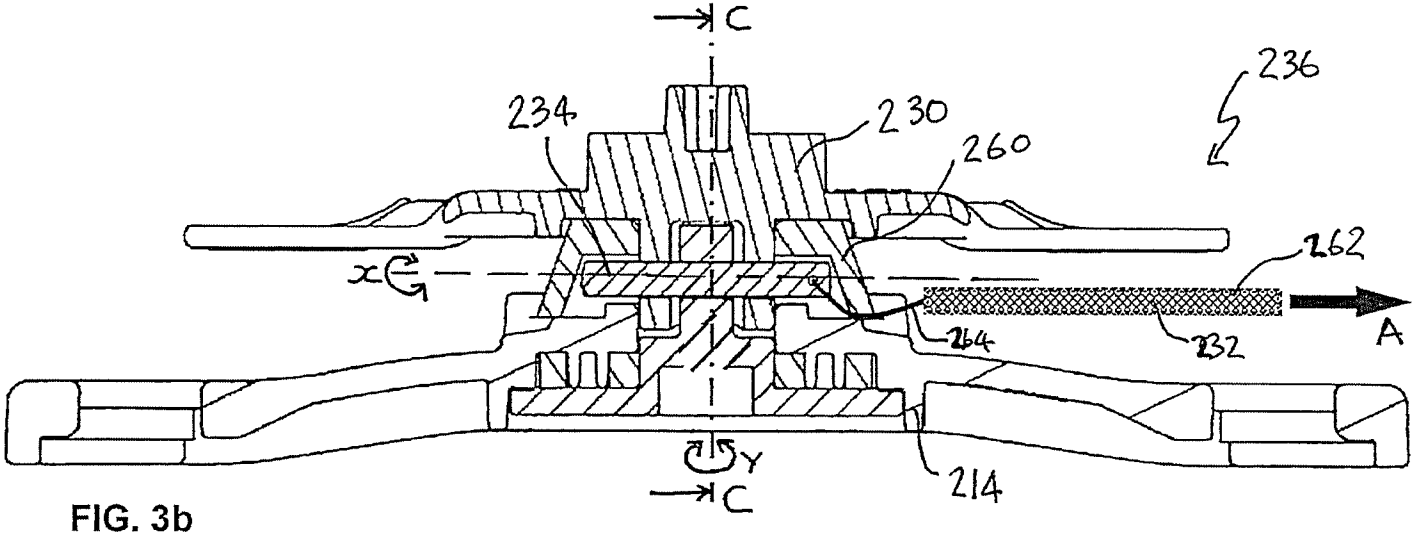
Figure 4:
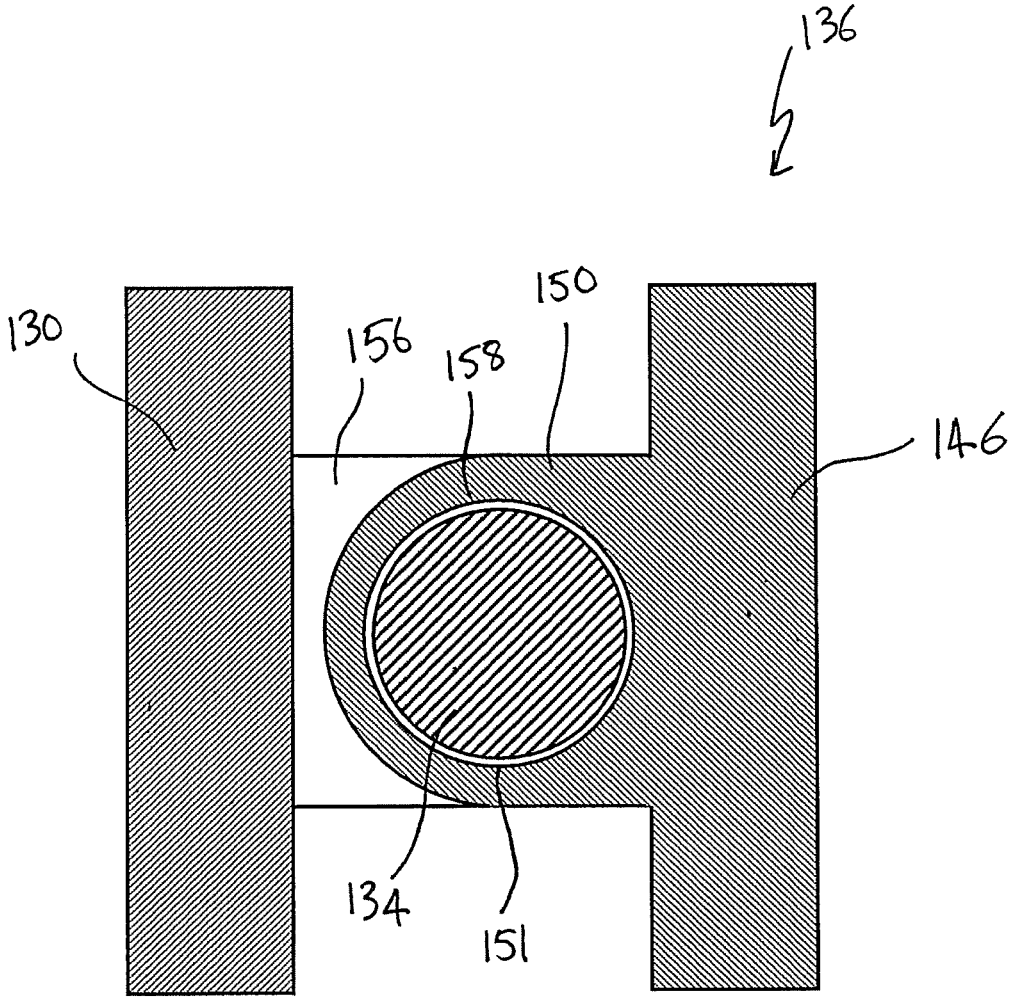

Embodiments of the invention will now be described, by way of example, with reference to the accompanying drawings, in which:

FIG. 1 schematically shows a rear view of harness for a self-contained breathing apparatus according to the present invention;

FIG. 2 schematically shows a front view of harness for a self-contained breathing apparatus according to the present invention FIG. 3*a* schematically shows a sectional view of a first embodiment of the harness of FIG. 2 along the section B-B;

FIG. 3*b* schematically shows a sectional view of a second embodiment of the harness of FIG. 2 along the section B-B; and FIG. 4 schematically shows sectional view of the harness of FIGS. 3*a* and 3*b* along the section C-C.

FIGS. 1 and 2 show a harness 100 is for a self-contained breathing apparatus (SCBA) from the rear and front respectively. When the harness 100 is worn by a user, the front side of the harness 100 shown in FIG. 2 is against the user's back.

The harness 100 comprises a structural support member 102, a waist belt 104, and shoulder straps 106. In use, the structural support member 102 is supported on a user's back when the shoulder straps 106 and waist belt 104 are worn by the user. Shoulder straps 106 are secured to the structural support member 102 at upper and lower ends of the structural support member 102 such that each of the shoulder straps 106 forms a loop. In use, the user can put one their arms through each of these loops such that a padded portions 108 of each shoulder strap 106 rests upon each of the user's shoulders. Accordingly, some of the weight of the structural support member 102 is supported on the user's shoulders.

The waist belt 104 of the harness 100 is located at the lower end of the structural support member 102. The waist belt 104 comprises a first portion 110 and a second portion 112 which extend in substantially opposing directions from a waist belt connector 114. The waist belt connector 114 connects the waist belt 104 to the lower end of the structural support member 102. In use, the first and second portions 110, 112 of the waist belt 104 are passed around the user's waist in opposite directions and secured together to form a continuous loop around the user's waist. The ends of the first and second portions 110,112 are not shown in FIGS. 1 and 2, each of the first and second portions 110, 112 may be connected to each other around the user by a releasable connection, such as a clip buckle, to thereby form a complete belt loop.

The structural support member 102 itself comprises two parallel rails 116 which extend from a lower end 118 to an upper end 120 of the structural support member 102. A retaining strap 122 is provided on the structural support member 102 for retaining a canister (not shown) of breathable gas. Such a canister can be connected to a valve 124 arranged at the lower end 118 of the structural support member 102. Air supply hoses, or conduits, 126, 128 are connected to the valve 124 for supplying breathable gas to a breathing apparatus (not shown) and a pressure gauge (not shown). The structural support member 102 comprises a structural support member connector 130 for connecting to the waist belt connector 114 of the waist belt 104. The structural support member connector 130 is slidable in a slot 131 on the structural support member 102 such that the relative positions of the structural support member 102 and the waist belt 104 is variable by moving the structural support member connector 130 along the slot 131.

The harness 100 also comprises a release strap 132. The release strap 132 can be pulled away from the harness 100 in order to disconnect the structural support member 102 from the waist belt 104. The mechanism of this release will be described in more detail in FIG. 3*a*.

FIG. 3*a* shows a cross section of a pivot joint mechanism 136 of the harness along the section B-B shown in FIG. 2. The pivot joint mechanism 136 comprises the waist belt connector 114 and the structural support member connector 130 and a release part 134, in the form of a pivot pin. The pivot joint mechanism 136 couples the structural support member 102 to the waist belt 104 and also provides articulation between the structural support member 102 and the waist belt 104 to provide improved freedom of movement to a wearer of the harness.

The waist belt connector 114 comprises a belt plate 138 having side portions 139 which extend in substantially opposite directions from a central portion 140. The side portions each comprise a slot 142 for connecting one of the first and second portions 110, 112 of the waist belt 104 to the belt plate. Central portion 140 of the belt plate 138 comprises a circular recess 144.

The circular recess 144 houses a belt link member 146. The belt link member 146 comprises a circular plate 148 of slightly smaller diameter than the circular recess 144 of the belt plate 138. A joint knuckle 150 extends from a centre of the circular plate 148 perpendicular to the plate through a central bore 152 in the central recess 144 of the belt plate 138. The joint knuckle 150 generally extends towards the structural support member connector 130.

As can be seen with reference to FIG. 4, which schematically shows a cross section of the pivot joint mechanism 136 on the section C-C shown in FIG. 3*a*, the joint knuckle 150 has a cylindrical bore 151 formed therethrough for receiving the pivot pin 134.

As the circular plate 148 of the link member 146 is received in the circular recess 144 of the belt plate 138 and not secured to each other, the link member 146 and the belt plate 138 are free to rotate with respect to one another about a rotational axis Y defined by the central bore 152. A stop mechanism may be provided to limit an angular extent of the rotation between the link member 146 and the belt plate 138. Accordingly, a first axis of rotation Y is provided for improved freedom of movement between the structural support member 102 and the waist belt 104 as the harness wearer moves. In other cases, the waist belt connector 114 may not comprise the link member and belt plate rotation arrangement, and may simply be formed of a solid piece having a joint knuckle 150 extending therefrom.

The structural support member connector 130 comprises a sliding part 154 which is slidably secured in the slot 131 of the structural support member 102. In other cases, the structural support member connector may not be slidable with respect to the structural support member 102 or may be integrally formed therewith. The structural support member connector comprises two joint knuckles 156 which extend from the structural support member connector 130 towards the waist belt connector 114.

Each of the joint knuckles 156 comprises a cylindrical bore 151 similar to the bore of the joint knuckle 150 of the waist belt connector 114 for receiving the pivot pin 134 (See FIG. 4). The two joint knuckles 156 are spaced apart along the shared axis of their cylindrical bores 151 by a distance substantially equal to, or slightly greater than, a width of the joint knuckle 150 of the waist belt connector 114 along the same axis. Accordingly, the joint knuckle 150 of the waist belt connector 114 can be arranged between the joint knuckles 156 of the structural support member connector 130 such that the cylindrical bores 151 of the joint knuckles 150, 156 are axially aligned to form a cylindrical barrel 158 of the pivot joint mechanism 136. The pivot pin 134 has an outer diameter slightly smaller than the inner diameter of the barrel 158 such that the pivot pin 134 can be inserted within the barrel 158 to connect the knuckles 150,156, and thereby connect the waist belt connector 114 and the structural support member connector 130 to form a pivot joint having a pivot axis x defined by the pivot pin 134.

Accordingly, the structural support member 102 and the waist belt 104 may pivot relative to each other about this pivot axis x. As the pivot axis x is substantially horizontal and proximate to the waist of the wearer, the pivot joint mechanism 136 permits the harness to bend at the waist, thereby improving freedom of movement.

A dish-shaped gaiter 160 surrounds the knuckles 150,156 and the pivot pin 134 to thereby prevent the ingress of dirt or grit which might inhibit the movement of the pivot joint mechanism 136. The gaiter is formed of a resiliently deformable material, such as rubber or silicone, such that it can flex as the joint moves to maintain a seal against the waist belt connector 114 and the structural support member connector 130.

In order to decouple the structural support member 102 from the waist belt 104, the pivot pin 134 is arranged to be removed from the pivot joint mechanism 136. As shown in FIG. 3*a*, the pivot pin 134 is connected to the release strap 132 (not shown to scale). The release strap 132 comprises a grip strap 162 and a link strap 164. The link strap 164 is directly connected to the pivot pin 134 via a hole 166 formed through the pivot pin 134. The link strap 164 is connected to one end of the grip strap 162, which is graspable by the wearer to apply a pulling force to the pivot pin 134. A hole is provided in the gaiter 160 in order for the release strap 132 to be connected to the pin 134, and to allow the pin 134 to be removed therethrough.

When it is desired to decouple the structural support member 102 from the waist belt 104, the release strap 132 can be pulled in the direction of arrow A in order to apply a force on the pivot pin 134 substantially along the pivot axis x of the pin 134. A detent 168 is provided on the pin in the form of a sprung ball-bearing. When the pin 134 is pulled by the release strap 132, the detent 168 contacts the knuckle 156. Thus, a sufficient force must be applied to the release strap 134 to retract the detent 168 into the pin 134 such that it be pulled axially through and out of the barrel 158.

Once the pivot pin 134 has been removed from the knuckles 150,156, the knuckles are no longer connected, and the waist belt connector 114 and the structural support member connector 130 are decoupled. Accordingly, the structural support member 102 can be removed from the wearer by taking off the shoulder straps 106, while the waist belt 104 remains attached to the wearer.

If it is desired to re-couple the structural support member 102 and the waist belt 104, then the knuckles 150, 156 can be re-aligned to form the barrel 158, and the pivot pin 134 can be reinserted into the barrel to re-form the pivot joint mechanism.

Accordingly, the pivot joint mechanism 136 provides dual functions of articulation between the structural support member 102 and the waist belt 104 and decoupling of the structural support member 102 and the waist belt 104.

The grip strap 162 of the release strap 132 may have a highly visible or textured portion which can be readily identified by a wearer of the harness in low- or no-visibility situations. As the release strap 132 will generally only be pulled in immediately life-threatening situations, it is imperative that it can be found quickly at all times. For example, the grip strap 162 may easily distinguishable from the remainder of the harness with a brightly coloured or high-visibility portion. The portion could be reflective, luminescent, fluorescent, phosphorescent, or any combination thereof. The portion could also be a textured part which is distinguishable from other parts of the SCBA by touch. Furthermore, the release strap 132 might be stored in a storable configuration where it can be readily located. For example, a pouch may be provided on the harness 100, such as on the waist belt 104, in which the release strap 132 can be stored. Such a configuration has advantages in that the location of the release strap 132 will always be the same, so it can be operated by the wearer even on low visibility, and in that the release strap 132 is stowed away to prevent it being pulled accidentally.

A second embodiment of a pivot joint mechanism 236 is shown in FIG. 3*b*. The construction of structural support member waist belt connector 214 and the connector 230 the pivot joint mechanism 236 is substantially similar to those of the pivot joint mechanism 136 and the cross section C-C of pivot joint mechanism 236 is substantially identical to that shown in FIG. 4. However, pivot joint mechanism 236 differs in that the gaiter 260 does not comprise a hole through which the release strap 134 can pass. Furthermore, no detent is provided in the pivot pin 234.

Accordingly the release strap 232, and in particular the link strap 264, must pass between the gaiter 260 and the waist belt connector 214. The link strap 264 is formed of a thin cord which does not substantially affect the seal of the gaiter 260 to the waist belt connector 214. As the gaiter 260 surrounds both ends of the pivot pin 234, it prevents movement of the pivot pin 234 along its axis x to avoid the pin 234 being removed accidentally.

When it is desired to remove the pivot pin 234, the release strap 232 is pulled. The link strap 264 therefore tends to straighten, which will lift the resiliently deformable gaiter 260 away from the waist belt connector 214. Accordingly, the gaiter 260 is deformed to such an extent that the pivot pin 234 is no longer blocked from axial movement by the gaiter 260, and the pin 234 can be freely removed. Of course, sufficient force must applied to the release strap 232 to adequately deform the gaiter 260 out of the way of the pin 234, so it will be understood that no detent may be required on the pin to prevent accidental axial movement of the pin, which would otherwise be arrested by the gaiter 260.

Although it has been described that the harness is for self-container breathing apparatus, in other embodiments it could be a harness for other types of breathing apparatus.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A harness for breathing apparatus, comprising:

a structural support member for supporting a vessel of breathable gas;

a waist belt; and a pivot joint mechanism coupling the structural support member to the waist belt and permitting pivoting movement therebetween, the pivot joint mechanism including a waist belt connector, a structural support member connector and a pivot pin, wherein the pivot joint mechanism permits movement of the structural support member with respect to the waist belt about at least two orthogonal pivot axes, and wherein the pivot pin is removable from both the waist belt connector and the structural support member connector by pulling the pivot pin along a first pivot axis of the at least two pivot axes while the harness is being worn by a user, to decouple the structural support member from the waist belt, and to decouple the vessel of breathable gas from the user.

2. The harness of claim 1, wherein the pivot joint mechanism additionally permits movement of the structural support member with respect to the waist belt in a linear direction.

3. The harness of claim 1, wherein in the at least two pivot axes comprise a first pivot axis and a second pivot axis, such that that first pivot axis is perpendicular to the second pivot axis.

4. The harness of claim 3, wherein the first pivot axis is a rotational pivot axis.

5. The harness of claim 4, wherein the second pivot axis is a rotational pivot axis.

6. The harness of claim 1, wherein the pivot pin may be inserted into an opening in the waist belt connector to couple the waist belt connector to the structural support member.

7. The harness of claim 1, wherein the waist belt connector includes a joint knuckle extending therefrom in a direction perpendicular to a first axis of the waist belt connector.

8. The harness of claim 7, wherein the joint knuckle includes a central bore disposed therein for receiving the pivot pin.

9. The harness of claim 8, wherein the central bore is a cylindrical bore.

10. The harness of claim 1, wherein the structural support member connector includes a sliding part for permitting linear movement of the structural support member with respect to the waist belt.

11. The harness of claim 3, wherein the first pivot axis extends through the pivot pin.

12. The harness of claim 3, wherein the second pivot axis extends in a direction perpendicular to the primary axis of the pivot pin.

* * * * *